US010689825B1

(12) United States Patent
Gelina

(10) Patent No.: US 10,689,825 B1
(45) Date of Patent: Jun. 23, 2020

(54) RADON REMOVAL APPARATUS

(71) Applicant: Jamey Gelina, Wellington, FL (US)

(72) Inventor: Jamey Gelina, Wellington, FL (US)

( * ) Notice: Subject to any disclaimer, the term of this patent is extended or adjusted under 35 U.S.C. 154(b) by 157 days.

(21) Appl. No.: 15/937,408

(22) Filed: Mar. 27, 2018

(51) Int. Cl.
*F24F 7/06* (2006.01)
*E02D 31/00* (2006.01)

(52) U.S. Cl.
CPC ..... *E02D 31/008* (2013.01); *F24F 7/06* (2013.01)

(58) Field of Classification Search
CPC ..... E02D 31/008; E02D 27/42; F24F 7/06
USPC ..... 454/354, 8, 14–15, 36, 41
See application file for complete search history.

(56) References Cited

U.S. PATENT DOCUMENTS 4,995,309 A * 2/1991 Weaver ..... E02D 31/008 285/64
6,044,835 A * 4/2000 Brown ..... F23L 17/04 126/307 A
2002/0166587 A1* 11/2002 Weaver ..... E02D 31/008 137/312

* cited by examiner

*Primary Examiner* — Helena Kosanovic
(74) *Attorney, Agent, or Firm* — Gulf Coast Intellectual Property Group

(57) ABSTRACT

A radon gas removal apparatus that is operable to substantially inhibit the entrance of radon gas into a structure. The radon gas removal apparatus is operably coupled to an area to which the structure is superposed. A housing is further included wherein the housing has a lower portion and upper portion mateably coupled. A blower assembly is present within the housing and is mounted in a vertical upright position. The lower portion of the housing includes a bottom having a mount extending upward therefrom to which the blower assembly is operably coupled utilizing a coupling. A fluid aperture is present in the mount and is operable to facilitate the egression of accumulated fluid present at the bottom of the housing into a connected pipe. The housing further includes an air turbulence diffusion member present on an exit aperture formed in the upper portion of the housing.

11 Claims, 3 Drawing Sheets

RADON REMOVAL APPARATUS

FIELD OF INVENTION

The present invention relates generally to gas evacuation systems, more specifically but not by way of limitation, a radon removal apparatus that is operably coupled to an area underneath a residential or commercial structure wherein the radon removal apparatus functions to remove radon gas that accumulates underneath the structure and vent the gas to atmosphere.

BACKGROUND

Radon gas is a colorless, odorless and tasteless noble gas that is radioactive. Radon gas naturally occurs in small quantities as an intermediate step in the normal radioactive decay chains through which elements such as but not limited to thorium slowly decay into lead and other short-lived radioactive elements. Despite radon's short half-life, it is continuously being regenerated and as such its presence will remain long into the future. Radon gas is considered a health risk as it is typically the single largest contributor to an individuals background radiation dose. The presence of radon gas varies locally from region to region based on the geology of each region. Studies have shown that breathing air that has a high concentration of radon gas demonstrates a clear link to lung cancer. In the US, radon gas is the second leading cause of lung cancer behind cigarette smoking.

Radon gas typically enters a building through the soil through the lowest level in the building. Entry points can be cracks in foundations, construction joints and gaps around service pipes just to cite a few. Existing technologies for removal of radon gas include fan systems that are fluidly coupled to the ground underneath a building structure in at least one location. The fans are operable to exhaust the radon gas to the atmosphere and inhibit the radon gas from entering the building.

One issue with existing radon removal fans is their inability to have the blower mounted in an upright position in an inline pipe system. Existing technology does not promote the most efficient mounting of the blower and as such the removal efficiency. Additionally, most radon fans are mounted outdoors and as such are subject to humidity and temperature changes. The exposure to humidity and temperature changes results in accumulation of condensation in the system and existing technology lacks the elements to provide removal thereof. Lastly, exit vents of existing radon fans have a velocity of air traversing therethrough that is sufficient to create noise during operation which can be undesirable for homeowners.

Accordingly, there is a need for a radon removal system that includes a housing wherein the housing design provides the ability for an impeller disposed therein to be mounted in a vertical position and wherein the housing further provides drainage elements so as to facilitate the removal of condensation from the interior of the housing.

SUMMARY OF THE INVENTION

It is the object of the present invention to provide a radon removal apparatus that is operable to inhibit radon from entering a building that includes a housing wherein the housing has a lower portion and an upper portion wherein the lower portion and upper portion are contiguously formed.

Another object of the present invention is to provide a radon removal apparatus configured to evacuate radon from an area wherein the lower portion of the housing is annular in shape and includes a bottom.

A further object of the present invention is to provide a radon removal apparatus that is operable to inhibit radon from entering a building wherein the bottom of the housing is configured to mateably connect to a pipe.

Still another object of the present invention is to provide a radon removal apparatus configured to evacuate radon from an area wherein the bottom of the housing includes a mounting portion extending from the exterior surface thereof that is configured to couple to a pipe.

An additional object of the present invention is to provide a radon removal apparatus that is operable to inhibit radon from entering a building wherein the bottom of the housing in the lower portion includes a pedestal extension extending upwards from the interior surface of the bottom of the housing wherein the pedestal extension is configured to receive a blower assembly and maintain the blower assembly in a vertical upright position.

Yet a further object of the present invention is to provide a radon removal apparatus configured to evacuate radon gas from an area wherein the upper portion of the housing is tapered inward and includes an exhaust opening proximate the top thereof.

Another object of the present invention is to provide a radon removal apparatus that is operable to inhibit radon from entering a building wherein the exhaust opening formed at the top of the upper portion of the housing is annular in shape and includes at least one cross member extending diametrically thereacross.

An alternate object of the present invention is to provide a radon removal apparatus configured to evacuate radon gas from an area wherein the bottom of the housing further includes at least one drain port that is configured to facilitate the removal of condensation from the interior of the housing.

Still a further object of the present invention is to provide a radon removal apparatus that is operable to inhibit radon from entering a building that includes a low voltage direct current motor configured to operate the vacuum impeller of the blower assembly.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
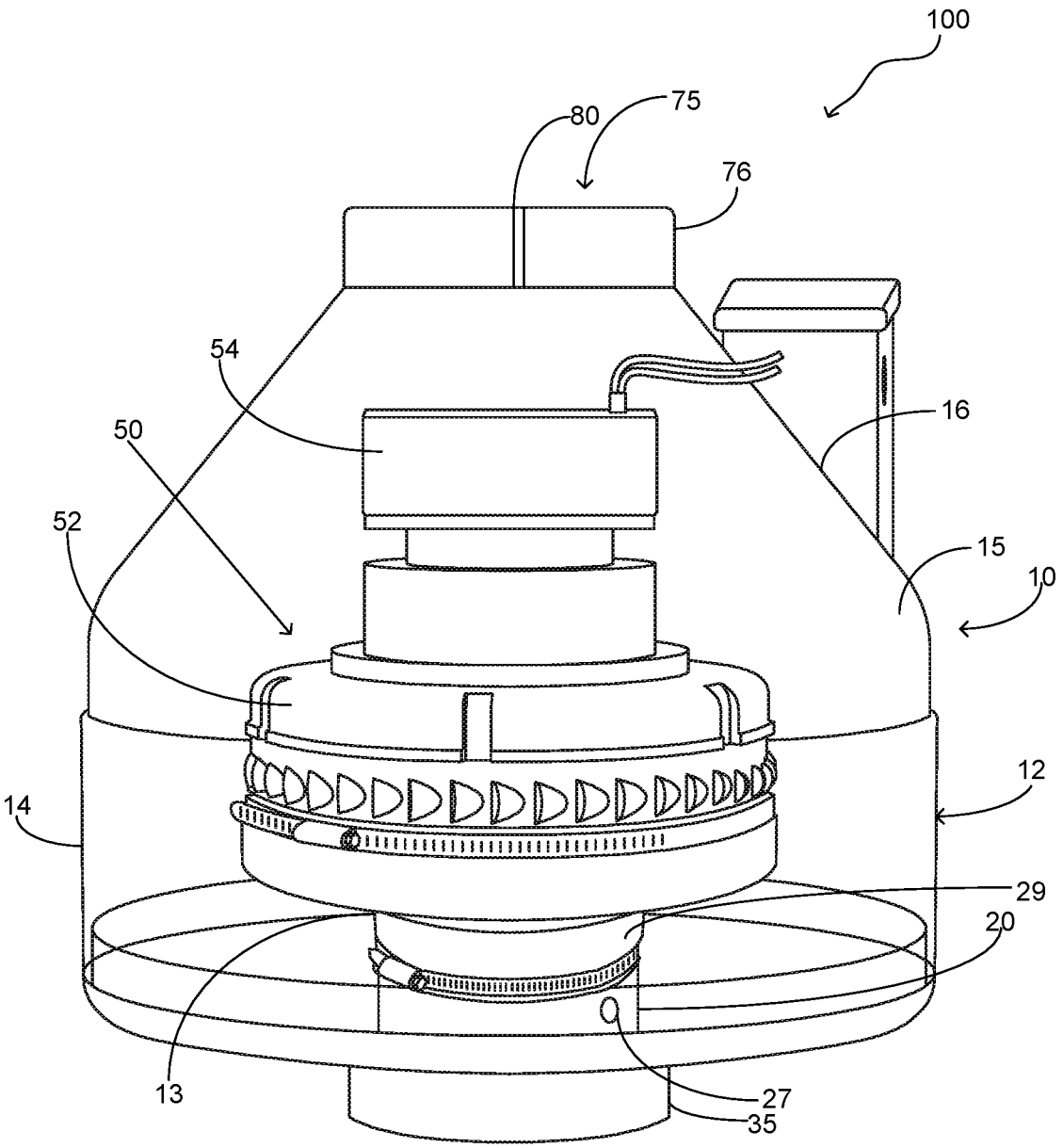
FIG. 1 is an internal view of a preferred embodiment of the present invention.
Figure 2:
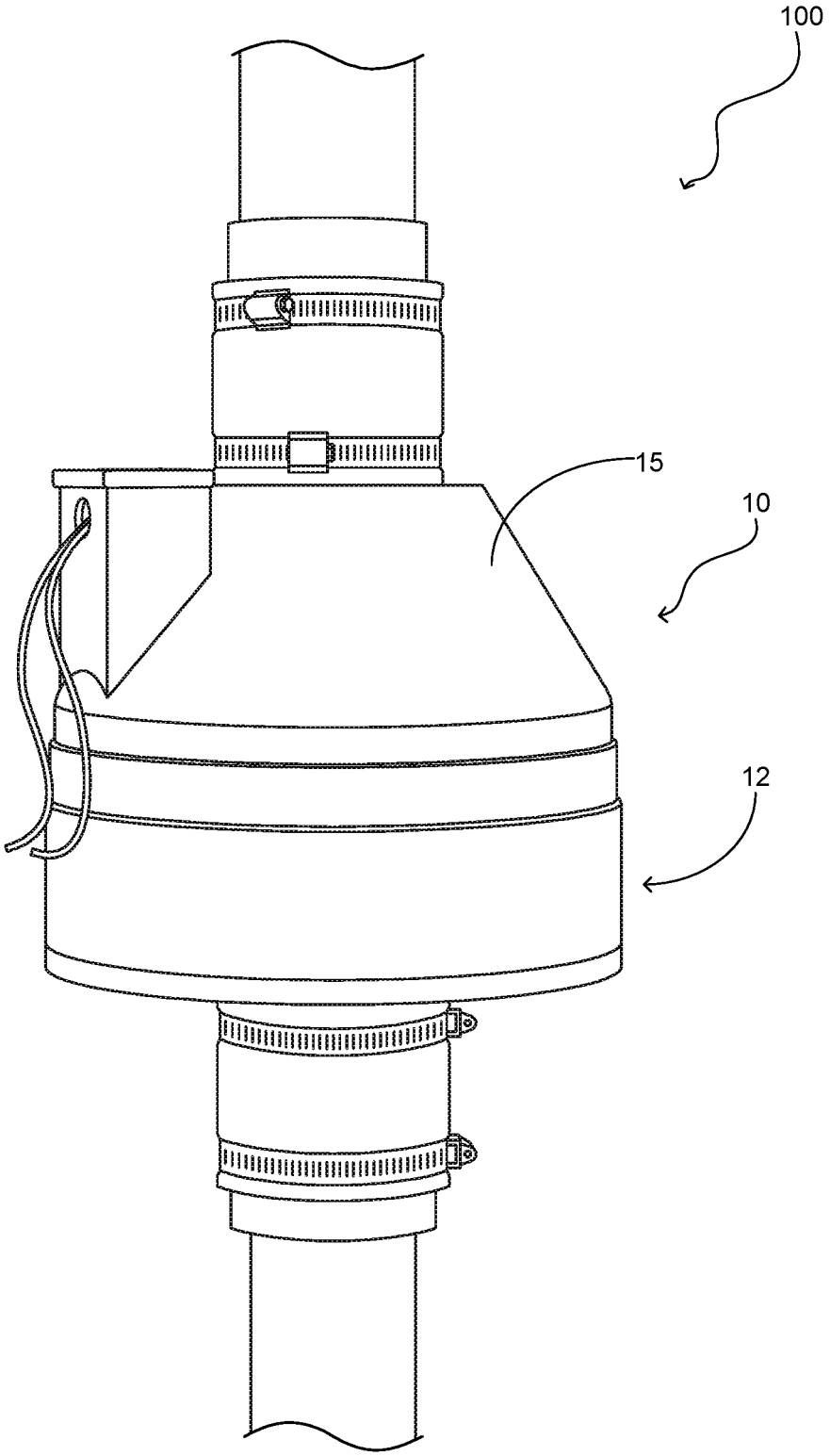
FIG. 2 is an exterior view of the present invention in the preferred mounting configuration.
Figure 3:
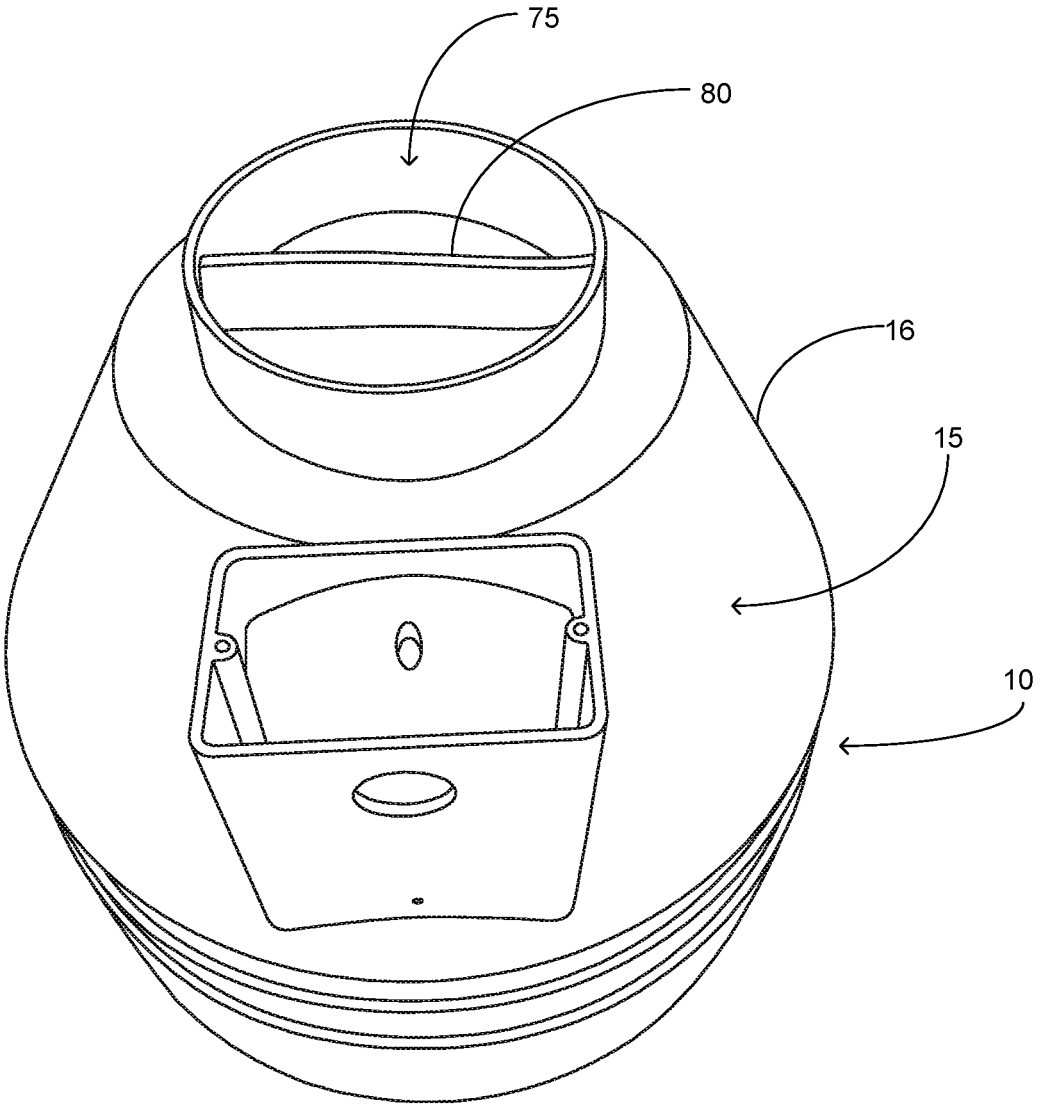
FIG. 3 is a top perspective view of the housing of the present invention.

Referring now to the drawings submitted herewith, wherein various elements depicted therein are not necessarily drawn to scale and wherein through the views and figures like elements are referenced with identical reference numerals, there is illustrated a radon removal apparatus 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to FIG. 1, the radon removal apparatus 100 further includes a housing 10. The housing 10 is manufactured from a durable suitable material such as but not limited to plastic. The housing 10 includes a lower portion 12 and an upper portion 15. The upper portion 15 and lower portion 12 are mateably coupled utilizing suitable durable techniques. The housing 10 is separable so as to provide access to the blower assembly 50. The lower portion 12 includes bottom 13 and wall 14 wherein the bottom 13 and wall 14 are contiguously formed utilizing suitable techniques. The wall 14 is perpendicular in orientation from the bottom 13 and extends upward therefrom. While the housing 10 is illustrated herein having a lower portion 12 and upper portion 13, it is contemplated within the scope of the present invention that the housing 10 could be formed in alternate shapes. It is preferred however that the housing 10 be comprised of two operable coupled portions.

Integrally formed with the bottom 13 in the center thereof is mount 20. Mount 20 is formed from a suitable durable material such as but not limited to plastic and is annular in shape having a passage(not illustrated herein) therethrough. Mount 20 extends upward from the bottom 13 and is operable to couple to the blower assembly 50. The mount 50 functions to provide a technique to position and maintain the blower assembly 50 in a vertical upright position without the need for additional structural members within the interior volume of the housing 10. The mount 20 is opposedly formed from the pipe connector 35 that is contiguously formed with the bottom 13. Pipe connector 35 is annular in shape having a hollow passage(not illustrated herein) and extends outward from the bottom 13 and is perpendicular thereto. The pipe connector 35 functions to be mateably coupled to a conventional plumbing pipe utilizing suitable durable techniques. Journaled through mount 20 is fluid aperture 27. Fluid aperture 27 functions to fluidly couple the mount 20 with the interior of the housing 10. As the radon removal apparatus 100 is mounted in outdoor environments the exposure to temperature fluctuations results in the accumulation of condensation within the housing 10. As the condensation accumulates the fluid level will collect on the bottom 13. The fluid aperture 27 facilitates the removal of the collected condensation from the bottom 13 and allows the fluid to egress through the fluid aperture 27 and into a pipe to which the housing 10 has been operably coupled. The removal of the condensation reduces the humidity of the interior volume of the housing 10 and as such provides an improved environment for operation of the blower assembly 50 promoting the longevity of operation of the components thereof. It is contemplated within the scope of the present invention that while only one fluid aperture 27 is illustrated and discussed herein that more than one fluid aperture 27 could be journaled through the mount 20 so as to facilitate the drainage of fluid accumulated at the bottom 13.

The blower assembly 50 is operable to facilitate the flow of radon gas upwards from the bottom 13 towards the exit aperture 75 formed in the upper portion 15 of the housing 10. The blower assembly 50 is mounted in an upright orientation and further includes an impeller 52 and motor 54. The impeller 52 draws radon gas upward from the bottom 13 through mount 20 and expels the radon gas through the exit aperture 75. The upper portion 15 includes wall 16 that is tapered inward so as to direct the flow of gas towards the exit aperture 75 that is integrally formed with the wall 16. In the preferred embodiment of the present invention the impeller 52 is a high pressure vacuum impeller in order to provide the most effective throughput and removal of gas. The impeller 52 is electrically coupled to a motor 54 providing operation thereof. While no particular electric motor is required, in the preferred embodiment of the present invention the motor 54 is a low voltage direct current motor wherein the motor 54 is additionally water resistant.

The blower assembly 50 is secured to mount 20 via coupling 29. Coupling 29 is annular in form having a hollow passage(not illustrated herein) and is operable to provide a technique to couple the impeller 52 to the mount 20. The coupling 29 is manufactured from a vibration reducing material such as but not limited to rubber. Utilizing a material such as rubber provides a mounting technique for the blower assembly 50 that is substantially void of vibrational movement. Reduction of vibrational movement promotes reduced sound production and provides reduced stress on electronic components of the blower assembly 50.

Contiguously formed with the upper portion 15 is the exit aperture 75. The exit aperture 75 includes wall 76 that is angular in orientation to wall 16 and provides a shape that facilitates operable coupling to a conventional pipe or other object if desired. In the preferred embodiment the exit aperture 75 is atmospherically coupled to its immediate environment so as to provide release of the gas thereinto. The exit aperture 75 has formed thereacross a air turbulence diffusion member 80. The air turbulence diffusion member 80 is mounted within the exit aperture 80 so as to extend diametrically across. The air turbulence diffusion member 80 is manufactured from a suitable durable material such as but not limited to plastic. The air turbulence diffusion member 80 is formed as a flat bar and is present at the exit aperture 75 so as to disrupt the cyclonic air flow pattern exiting the housing 10. The formed shape of the upper portion 15 of the housing 10 coupled with the impeller 52 creates an airflow pattern that is circular in shape similar to a tornado or cyclone. This airflow pattern results in the production of significant noise which is undesirable for many applications such as but not limited to residential mounting locations of the radon removal apparatus 100. The shape of the air turbulence diffusion member 80 disrupts the circular air pattern egressing through the exit aperture 75 and as such substantially eliminates the production of noise produced by gas flowing outwards from the exit aperture 75. While the air turbulence diffusion member 80 is illustrated in a form of a flat crossbar herein, it is contemplated within the scope of the present invention that the air turbulence diffusion member 80 could be formed in alternate shapes in order to achieve the desired functionality as described herein.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A radon gas removal apparatus operable to inhibit entry of radon gas into a structure to which the radon gas removal apparatus is fluidly coupled to an area on which the structure is superposed comprising:

a housing, said housing having an interior volume, said housing having a lower portion and an upper portion, said upper portion and said lower portion being mateably coupled, said lower portion having a bottom and a wall integrally formed, said wall of said lower portion being perpendicular to said bottom and extending upward therefrom, said upper portion of said housing having a wall, said wall of said upper portion being tapered inwards, said upper portion having an exit aperture formed therein, said exit aperture being distal to said bottom portion of said housing, a mount, said mount being formed on said bottom of said lower portion, said mount being formed within said interior volume of said housing, said mount extending upward from said bottom, said mount having a a wall forming a hollow passage;

a pipe connector, said pipe connector being formed on said bottom of said lower portion opposite said mount, said pipe connector extending away from said housing, said pipe connector being annular in shape, said pipe connector configured to be mateably coupled to a pipe;

a fluid aperture, said fluid aperture being journaled through said wall of said mount, said fluid aperture being present proximate said bottom of said lower portion, said fluid aperture configured to facilitate drainage of accumulated fluid present at the bottom of said lower portion into said hollow passage of said mount; and a blower assembly, said blower assembly operable to facilitate movement of a gas through the interior volume of the housing said blower assembly being operably coupled to said mount, said mount configured to position said blower assembly in a vertical upright orientation, said blower assembly being elevated above the bottom of the lower portion of said housing.

2. The radon gas removal apparatus as recited in claim 1, and further including a coupling, said coupling being present intermediate said blower assembly and said mount further providing operable coupling thereof, said coupling being manufactured from a vibration reducing material.

3. The radon gas removal apparatus as recited in claim 2, wherein said blower assembly further includes an impeller, said impeller of said blower assembly being a high pressure vacuum impeller.

4. The radon gas removal apparatus as recited in claim 3, and further including an air turbulence diffusion member, said air turbulence diffusion member being mounted across said exit aperture, said air turbulence diffusion member being a flat bar in form.

5. The radon gas removal apparatus as recited in claim 4, wherein said blower assembly further includes a direct current electric motor, said direct current electric motor configured to operate said impeller.

6. The radon gas removal apparatus as recited in claim 5, wherein the air turbulence diffusion member is mounted centrally across the exit aperture extending diametrically thereacross.

7. A radon gas removal apparatus operable to inhibit entry of radon gas into a structure comprising:

a housing, said housing having an interior volume, said housing having a lower portion and an upper portion, said upper portion and said lower portion being mateably coupled, said lower portion having a bottom and a wall integrally formed, said wall of said lower portion being perpendicular to said bottom and extending upward therefrom, said upper portion of said housing having a wall, said wall of said upper portion being tapered inwards, said upper portion having an exit aperture formed therein, said exit aperture being distal to said bottom portion of said housing, said exit aperture being annular in shape having a diameter;

a mount, said mount being contiguously formed with said bottom of said lower portion of said housing, said mount having a first end and a second end, said first end of said mount being proximate said bottom of said lower portion of said housing, said mount extending upward from said bottom, said mount having a wall forming a hollow passage;

a pipe connector, said pipe connector being formed on said bottom of said lower portion opposite said mount, said pipe connector extending away from said housing, said pipe connector being annular in shape, said pipe connector configured to be mateably coupled to a pipe;

at least one fluid aperture, said at least one fluid aperture being journaled through said wall of said mount, said at least one fluid aperture being journaled through said wall of said mount proximate said first end thereof, said at least one fluid aperture configured to facilitate drainage of accumulated fluid present at the bottom of said lower portion of said housing into said hollow passage of said mount;

a blower assembly, said blower assembly further including an impeller and a motor operably coupled to said impeller, said blower assembly being operably coupled to said second end of said mount, said mount configured to position said blower assembly in an elevated and upright position with respect to said bottom of said lower portion of said housing, said blower assembly operably to facilitate movement of a gas through the interior volume of the housing; and an air turbulence diffusion member, said air turbulence diffusion member being centrally mounted across the diameter of said exit aperture, said air turbulence diffusion member configured to provide disruption of an air flow pattern exiting said exit aperture.

8. The radon gas removal apparatus as recited in claim 7, wherein the air turbulence diffusion member is a flat bar.

9. The radon gas removal apparatus as recited in claim 8, wherein the impeller of the blower assembly is a high vacuum impeller.

10. The radon gas removal apparatus as recited in claim 9, and further including a coupling, said coupling being intermediate said mount and said blower assembly, said coupling configured to operably couple said blower assembly and said mount.

11. The radon gas removal apparatus as recited in claim 10, wherein the coupling is manufactured from a vibration reducing material.

* * * * *